US007988535B2

(12) United States Patent
Chen et al.

(10) Patent No.: US 7,988,535 B2
(45) Date of Patent: Aug. 2, 2011

(54) PLATEN EXHAUST FOR CHEMICAL MECHANICAL POLISHING SYSTEM

(75) Inventors: Hung Chih Chen, Sunnyvale, CA (US); Allen L. D'Ambra, Burlingame, CA (US); Donald J. K. Olgado, Palo Alto, CA (US)

(73) Assignee: Applied Materials, Inc., Santa Clara, CA (US)

( * ) Notice: Subject to any disclaimer, the term of this patent is extended or adjusted under 35 U.S.C. 154(b) by 651 days.

(21) Appl. No.: 12/105,924

(22) Filed: Apr. 18, 2008

(65) Prior Publication Data

US 2009/0264049 A1 Oct. 22, 2009

(51) Int. Cl.
*B24B 7/22* (2006.01)
*B24B 55/12* (2006.01)

(52) U.S. Cl. ..... 451/41; 451/288

(58) Field of Classification Search ..... 451/287, 451/288, 289, 456, 41
See application file for complete search history.

(56) References Cited

U.S. PATENT DOCUMENTS 3,880,047 A * 4/1975 Dosier ..... 409/134
5,653,623 A * 8/1997 Kimura et al. ..... 451/72
6,251,001 B1 6/2001 Pinson et al.
6,309,279 B1 * 10/2001 Bowman et al. ..... 451/41
6,503,801 B1 1/2003 Rouse et al.
6,572,730 B1 * 6/2003 Shah ..... 156/345.12
7,323,058 B2 1/2008 Lubomirsky et al.
7,419,420 B2 9/2008 Togawa et al.
7,883,394 B2 2/2011 Togawa et al.
2007/0270081 A1 11/2007 Crocco et al.

* cited by examiner

*Primary Examiner* — Robert Rose

(74) *Attorney, Agent, or Firm* — Patterson & Sheridan, L.L.P.

(57) ABSTRACT

The present invention generally relates to a substrate transferring system. Particularly, the present invention relates to apparatus and method to effectively remove the chemical fume, vapor and other byproducts generated during a polishing process. One embodiment of the present invention provides an apparatus for polishing a substrate comprising a platen having a polishing surface configured to polish the substrate by contacting the substrate while moving relatively to the substrate, a polishing head configured to support the substrate and position the substrate to be in contact with the polishing surface during polishing, a solution nozzle configured to dispense a polishing solution on the polishing surface, and an exhaust assembly configured to remove fume, vapor and other byproducts generated during polishing.

13 Claims, 6 Drawing Sheets

PLATEN EXHAUST FOR CHEMICAL MECHANICAL POLISHING SYSTEM

BACKGROUND OF THE INVENTION

1. Field of the Invention

Embodiments of the present invention relate to apparatus and method for polishing semiconductor substrates.

2. Description of the Related Art

Sub-micron multi-level metallization is one of the key technologies for the next generation of ultra large-scale integration (ULSI). The multilevel interconnects that lie at the heart of this technology require planarization of interconnect features formed in high aspect ratio apertures, including contacts, vias, trenches and other features.

Planarization is generally performed using Chemical Mechanical Polishing (CMP) and/or Electro-Chemical Mechanical Deposition (ECMP). A planarization method typically requires that a substrate be mounted in a carrier head, with the surface to be polished exposed. The substrate supported by the carrier head is then placed against a rotating polishing pad. The carrier head holding the substrate may also rotate, to provide additional motion between the substrate and the polishing pad surface. A polishing solution is usually supplied to the rotating polishing surface to assist the planarization process.

During polishing process, chemical fume, vapor from the polishing solution, and other byproducts may generate and diffuse around the platen, polishing head and other devices impairing system cleanness, introducing defects and cross contamination among platens and substrates.

Conventional polishing system generally have a top exhaust or a bottom exhaust for the entire system, usually comprising at least several platens, several polishing heads, one or more load cups, one or more platen conditioners. The chemical fume, vapor and other byproducts generally need to travel across the system before entering the exhaust. As a result, a portion of chemical fume, vapor, and other byproducts would condense and remain on surfaces of the system. The condensed matter usually dries on the surfaces affecting the appearance. Moreover, dried polishing solution becomes flaky and causes defects in the substrate during processing.

Therefore, there is a need for apparatus and method to effectively remove the chemical fume, vapor, and other byproducts generated during a polishing process.

SUMMARY OF THE INVENTION

Embodiments of the present invention relate to apparatus and method to effectively remove the chemical fume, vapor and other byproducts generated during a polishing process.

One embodiment of the present invention provides an apparatus for polishing a substrate comprising a platen having a polishing surface configured to polish the substrate by contacting the substrate while moving relatively to the substrate, a polishing head configured to support the substrate and position the substrate to be in contact with the polishing surface during polishing, a solution nozzle configured to dispense a polishing solution on the polishing surface, and an exhaust assembly configured to remove fume, vapor and other byproducts generated during polishing.

Another embodiment of the present invention provides a method for polishing a substrate comprising securing the substrate to a polishing head with a device surface facing down, rotating a platen having a polishing surface facing up, dispensing a polishing solution to the polishing surface, pressing the device surface of the substrate against the polishing surface, wherein the polishing surface and the substrate move relatively, retaining fume, vapor and other byproducts generated during polishing within a confined volume, and vacuuming the confined volume to remove the fume, vapor and other byproducts.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

To facilitate understanding, identical reference numerals have been used, where possible, to designate identical elements that are common to the figures. It is contemplated that elements disclosed in one embodiment may be beneficially utilized on other embodiments without specific recitation.

DETAILED DESCRIPTION

The present invention generally relates to an apparatus and a method for removing chemical fume, vapor of polishing solution, and other byproducts generated during polishing process.

Figure 1:
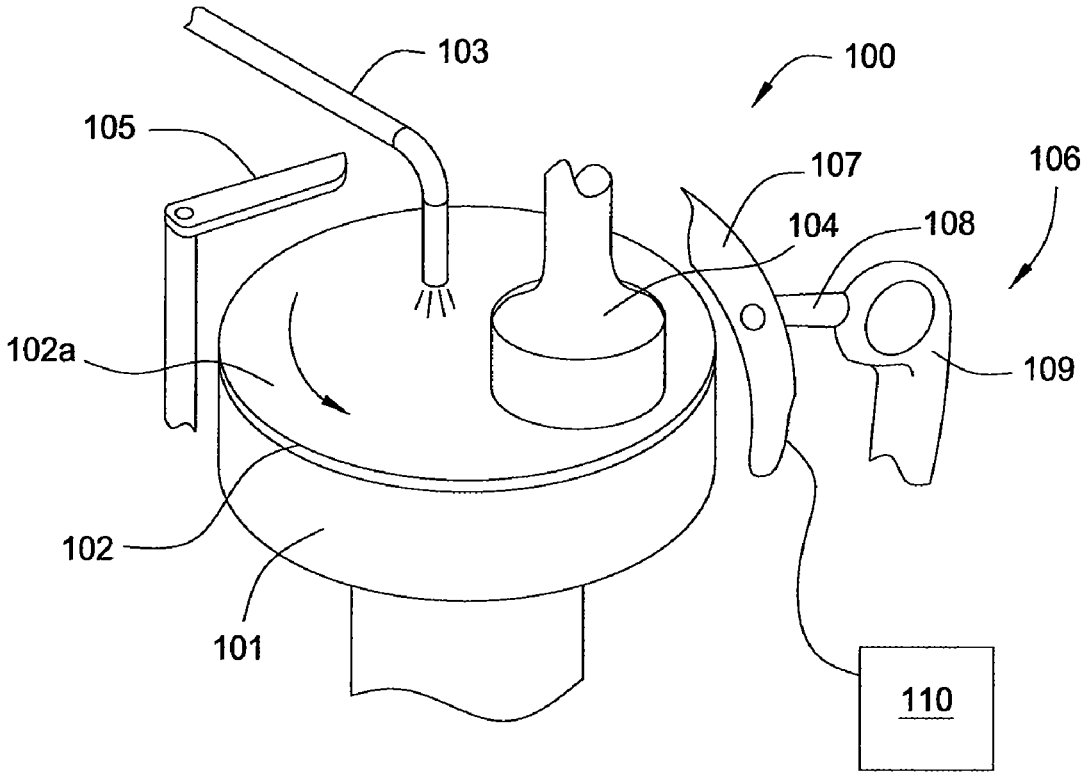
FIG. 1 schematically illustrates a polishing station in according to one embodiment of the present invention.

FIG. 1 schematically illustrates a polishing station 100 in according to one embodiment of the present invention. The polishing station 100 generally comprises a platen 101 having a polishing pad 102 disposed thereon. The polishing pad 102 has a polishing surface 102*a* configured to polishing a substrate when the substrate is in contact with and pressed against the polishing surface 102*a*. A nozzle 103 is configured to dispose a polishing solution on the polishing surface 102*a* during processing. The platen 101 usually rotates about a center axis during polishing. Detailed description of platen and polishing pads may be found in the U.S. Pat. No. 6,913,518, entitled "Profile Control Platen", which is incorporated herein by reference.

The polishing station 100 further comprises a polishing head 104 configured to transfer substrates and to support substrates during processing. The polishing head 104 moves relatively to and from the platen 101 to transfer substrates to and from load cups or other platens in a system. A substrate being transferred is generally secured on the polishing head 104 by vacuum with a device surface facing down so that the device surface may be pressed against the polishing surface 102*a* during processing. During polishing, the polishing head

104 presses the substrate against the polishing pad 102 and allows the substrate to be polished through relative motion between the substrate and the polishing surface 102*a* and/or chemical reaction with the polishing solution. The polishing head 104 may rotate about its central axis during processing. The polishing head 104 may also oscillate to generate a sweeping motion during polishing for a uniform result. Detailed description of polishing heads may be found in the U.S. Pat. No. 7,255,771, entitled "Multiple Zone Carrier Head with Flexible Membrane", which is incorporated herein by reference.

The polishing station 100 may also comprises a conditioner 105 configured to condition and maintain the platen 101. The conditioner 105 may movably disposed near the platen 101. During polishing, the conditioner 105 generally stays clear of the polishing surface 102*a*. During conditioning, the conditioner 105 may swirl above the platen 101 to measure attributes of the platen 101 and the polishing pad 102, and clean the polishing pad 102. A detailed description of a conditioner may be found in the U.S. Pat. No. 7,210,981, entitled "Smart Conditioner Rinse Station", which is incorporated herein by reference.

The polishing station 100 is generally a part of a polishing system which comprises two or more platens configured to perform multiple step polishing or to perform parallel polishing. The polishing system may comprise multiple polishing heads also so that at least one polishing head is available to contact each platen at any given time. The two or more platens are generally disposed in fixed position while the multiple polishing heads are configured to move relative to the two or more platens to transfer substrates among the two or more platens. The polishing system may further comprise one or more load cups configured to transfer substrates to and from the multiple polishing heads. The polishing system may also comprise one or more cleaners configured to clean the multiple polishing heads. The platens may be disposed in different formations and the polishing heads moved by different manners according to system design and process requirement. Exemplary polishing system may be found in the U.S. Pat. No. 6,818,066, entitled "Method and Apparatus for Treating a Substrate", which is incorporated herein by reference.

In one embodiment of the present invention, the polishing station 100 comprises a local exhaust assembly 106 configured to remove any chemical fume, vapor of polishing solution, or any byproduct generated in the polishing station 100 during polishing. The local exhaust assembly 106 generally comprises an exhaust shield 107 configured to confined the fume, vapor, and other byproducts within the premises of the polishing station 100. The local exhaust assembly 106 further comprises a fluid channel 108 in fluid communication with a confined volume enclosed by the exhaust shield 107. The fluid channel 108 is connected to a vacuum system 109 allowing the confined fume, vapor, and other byproducts to be removed by vacuum power. In one embodiment, the local exhaust assembly 106 further comprises a vertical motion assembly 110 configured to move the exhaust shield 107 vertically to adjust the confined volume or to allow the polishing head and the conditioner 105 to have full access to the platen 101.

The local exhaust assembly 106 allows effective removal of chemical fume, vapor of polishing solution, and any byproduct generated during polishing before such fume, vapor, and other byproducts have an opportunity to condense on surfaces of the polishing station 100 or travel into other part of the polishing system. The prompt removal of fume, vapor and other byproducts improves system cleanness and reduces defects and contamination. In a polishing system where multi-step polishing is performed, neighboring platens may be designated to perform different polishing while non-compatible polishing solutions may be used. The local exhaust assembly 106 prevents vapor of the chemical solution from travelling to other polishing station that uses a non-compatible solution, thus, reducing cross contamination.

Figure 2:
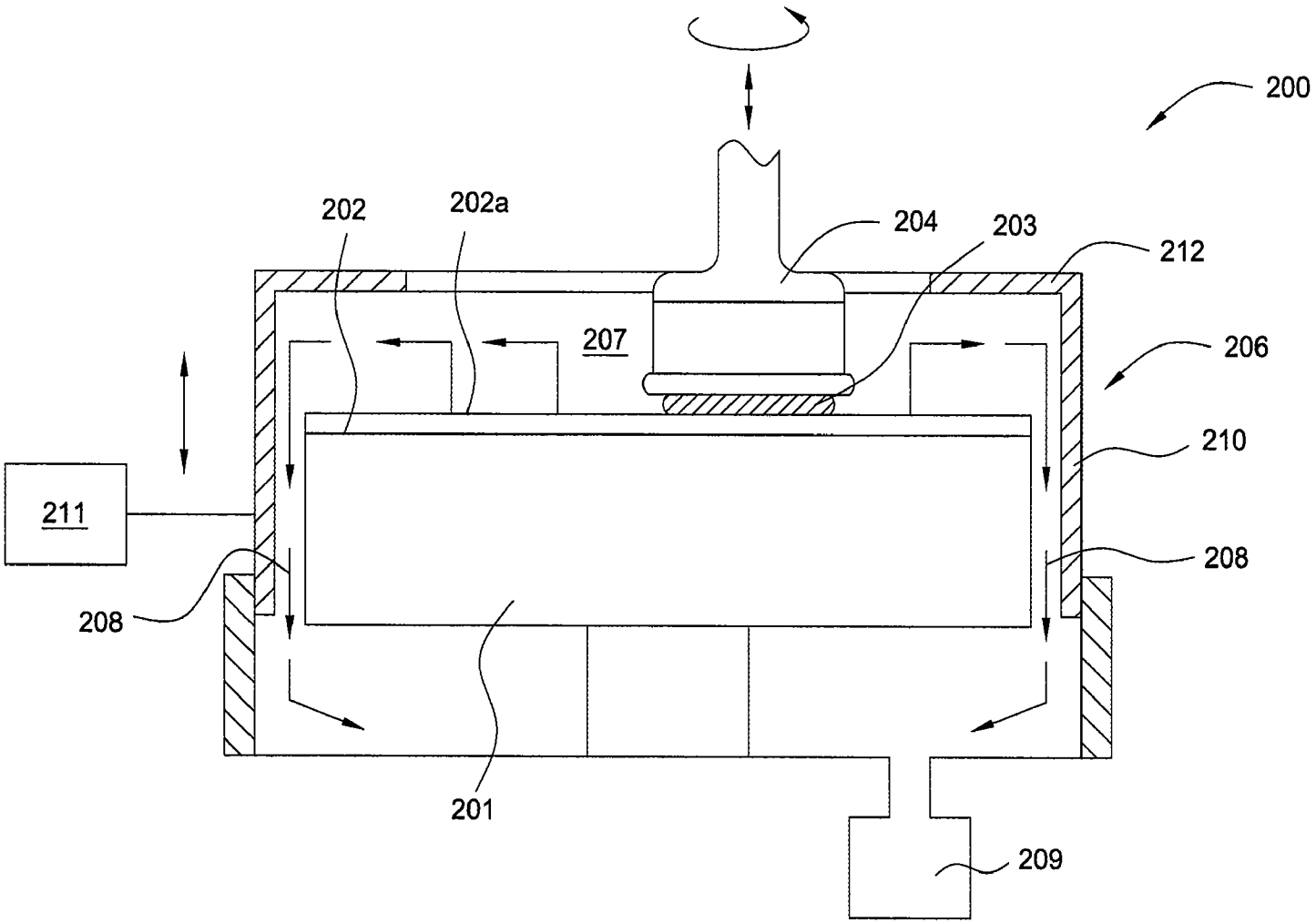
FIG. 2 is a schematic sectional side view of a polishing station in accordance with one embodiment of the present invention.

FIG. 2 is a schematic sectional side view of a polishing station 200 in accordance with one embodiment of the present invention. The polishing station 200 may be used in a polishing system or stand alone. The polishing station 200 generally comprises a platen 201 having a polishing pad 202 disposed thereon. The polishing pad 202 has a polishing surface 202*a* configured to polishing a substrate 203 when the substrate 203 is in contact with and pressed against the polishing surface 202*a*. The platen 201 usually rotates about a center axis during polishing.

The polishing station 200 further comprises a polishing head 204 configured to transfer the substrate 203 and to support the substrate 203 during processing. The polishing head 204 moves relatively to and from the platen 201 to transfer substrates to and from load cups or other platens in a system. The substrate 203 being processed is generally secured on the polishing head 204 by vacuum using a membrane with a device surface of the substrate 203 facing down. During polishing, the polishing head 204 presses the substrate against the polishing pad 202 and allows the substrate to be polished through relative motion between the substrate and the polishing surface 202*a* and/or chemical reaction by the polishing solution. The polishing head 204 may rotate about its central axis during processing. The polishing head 204 may also oscillate to generate a sweeping motion during polishing for a uniform result.

In one embodiment of the present invention, the polishing station 200 comprises an exhaust shield 206 configured to remove any chemical fume, vapor of polishing solution, or any byproduct generated in the polishing station 200 during polishing. The exhaust shield 206 surrounds the platen 201 defining a confined volume 207 and prevents chemical fumes, vapor of polishing solution and other byproducts from escaping out of the confined volume 207. A vacuum pump 209 is in fluid communication with the confined volume 207. During polishing, the chemical fume, vapor and other byproducts are removed from the confined volume 207 along a path 208 by the vacuum pump 209.

In one embodiment, the exhaust shield 206 comprises a sidewall 210 surrounding the platen 201 and a partial top 212 covering processing regions of the polishing head 204 and the platen 201. During processing, the partial top 212 may be slightly higher than the polishing surface 202*a* to effectively confine fume, vapor and byproducts. The exhaust shield 206 may be formed by material compatible with processing chemistry. In one embodiment, the exhaust shield 206 is made of polyvinyl chloride (PVC).

In one embodiment, the sidewall 210 and the partial top 212 may move vertically to allow conditioner or other maintenance devices to have access to the platen 201 and the polishing pad 202. In one embodiment, a vertical motion assembly 211 may be connected to the sidewall 210 and configured to move the exhaust shield 206 vertically to adjust the confined volume 207 or to allow polishing heads, conditioner or other maintenance devices to have full access to the platen 201.

Figure 3:
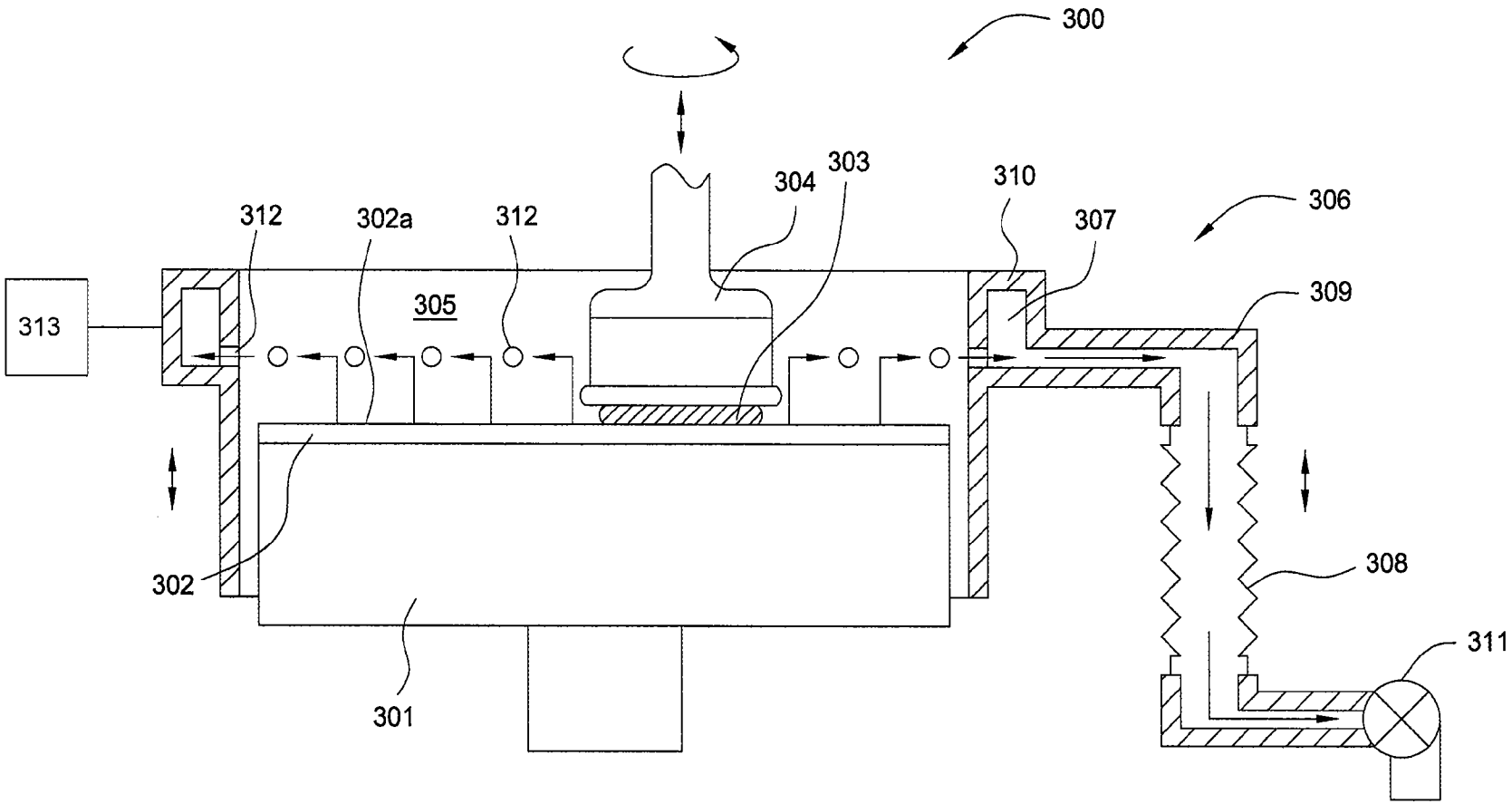
FIG. 3 is a schematic sectional side view of a polishing station in accordance with one embodiment of the present invention.

FIG. 3 is a schematic sectional side view of a polishing station 300 in accordance with one embodiment of the present invention. The polishing station 300 may be used in a polishing system or stand alone. The polishing station 300 generally comprises a platen 301 having a polishing pad 302 disposed thereon. The polishing pad 302 has a polishing surface 302*a* configured to polishing a substrate 303 when the substrate 303 is in contact with and pressed against the polishing surface 302*a*. The platen 301 usually rotates about a center axis during polishing.

The polishing station 300 further comprises a polishing head 304 configured to transfer the substrate 303 and to support the substrate 303 during processing. The polishing head 304 moves relatively to and from the platen 301 to transfer substrates to and from load cups or other platens in a system. The substrate 303 being processed is generally secured on the polishing head 304 by vacuum using a membrane with a device surface of the substrate 303 facing down. During polishing, the polishing head 304 presses the substrate against the polishing pad 302 and allows the substrate to be polished through relative motion between the substrate and the polishing surface 302*a* and/or chemical reaction by the polishing solution. The polishing head 304 may rotate about its central axis during processing. The polishing head 304 may also oscillate to generate a sweeping motion during polishing for a uniform result.

In one embodiment of the present invention, the polishing station 300 comprises a local exhaust assembly 306 configured to remove any chemical fume, vapor of polishing solution, or any byproduct generated in the polishing station 300 during polishing. The local exhaust assembly 306 surrounds the platen 301 near a processing volume 305, which includes areas near the polishing surface 302*a*.

The local exhaust assembly 306 provides fluid communication between the processing volume 305 and a vacuum system 311 and prevents chemical fumes, vapor of polishing solution and other byproducts from escaping out of the processing volume 305.

In one embodiment, the local exhaust assembly 306 comprises an exhaust duct 310 surrounding the processing volume 305. The exhaust duct 310 defines an inner volume 307 which is in fluid communication with the processing volume through openings 312 formed in an inner wall of the exhaust duct 310. The openings 312 may be evenly distributed along the exhaust duct 310. In one embodiment, the openings 312 may be one continuous opening along the exhaust duct 310.

The local exhaust assembly 306 further comprises a channel 309 connecting the exhaust duct 310 and the vacuum system 311. In one embodiment, the channel 309 may comprise a piece of bellows 308 allowing the exhaust duct 310 to move vertically along the platen 301. In one embodiment, a vertical motion assembly 313 may be connected to the exhaust duct 310 and configured to move the exhaust duct 310 vertically to adjust the confined volume 305 or to allow polishing head, conditioner or other maintenance devices to have full access to the platen 301.

The exhaust duct 310 may be formed by material compatible with processing chemistry. In one embodiment, the exhaust duct 310 is made of polyvinyl chloride (PVC).

Figure 4:
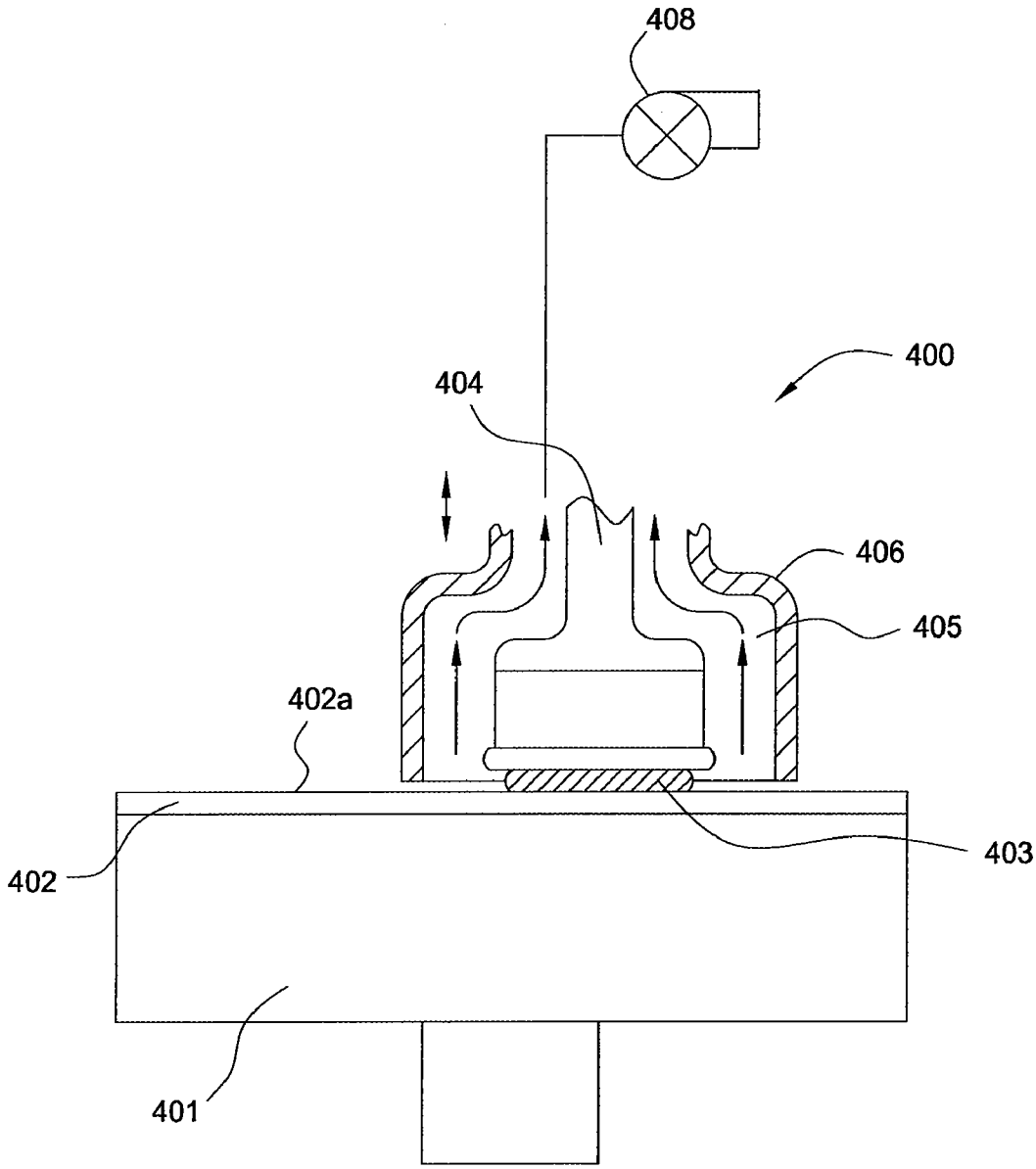
FIG. 4 is a schematic sectional side view of a polishing station in accordance with one embodiment of the present invention.

FIG. 4 is a schematic sectional side view of a polishing station 400 in accordance with one embodiment of the present invention. The polishing station 400 may be used in a polishing system or stand alone. The polishing station 400 generally comprises a platen 401 having a polishing pad 402 disposed thereon. The polishing pad 402 has a polishing surface 402*a* configured to polishing a substrate 403 when the substrate 403 is in contact with and pressed against the polishing surface 402*a*.

The polishing station 400 further comprises a polishing head 404 configured to transfer the substrate 403 and to support the substrate 403 during processing. The polishing head 404 moves relatively to and from the platen 401 to transfer substrates to and from load cups or other platens in a system. The substrate 403 being processed is generally secured on the polishing head 404 by vacuum using a membrane with a device surface of the substrate 403 facing down. During polishing, the polishing head 404 presses the substrate against the polishing pad 402 and allows the substrate to be polished through relative motion between the substrate and the polishing surface 402*a* and/or chemical reaction by the polishing solution. The polishing head 404 may rotate the substrate 403 about its central axis during processing. The polishing head 404 may also oscillate to generate a sweeping motion during polishing for a uniform result.

In one embodiment of the present invention, the polishing station 400 comprises an exhaust shield 406 configured to remove any chemical fume, vapor of polishing solution, or any byproduct generated in the polishing station 400 during polishing. The exhaust shield 406 is attached to the polishing head 404 and defines a confined volume 405 to retain chemical fumes, vapor of polishing solution and other byproducts. A vacuum system 408 is in fluid communication with the confined volume 405 and configured to remove any chemical fume, vapor and byproducts from the confined volume 405.

The exhaust shield 406 may be formed by material compatible with processing chemistry. In one embodiment, the exhaust shield 406 is made of polyvinyl chloride (PVC).

Figure 5A:
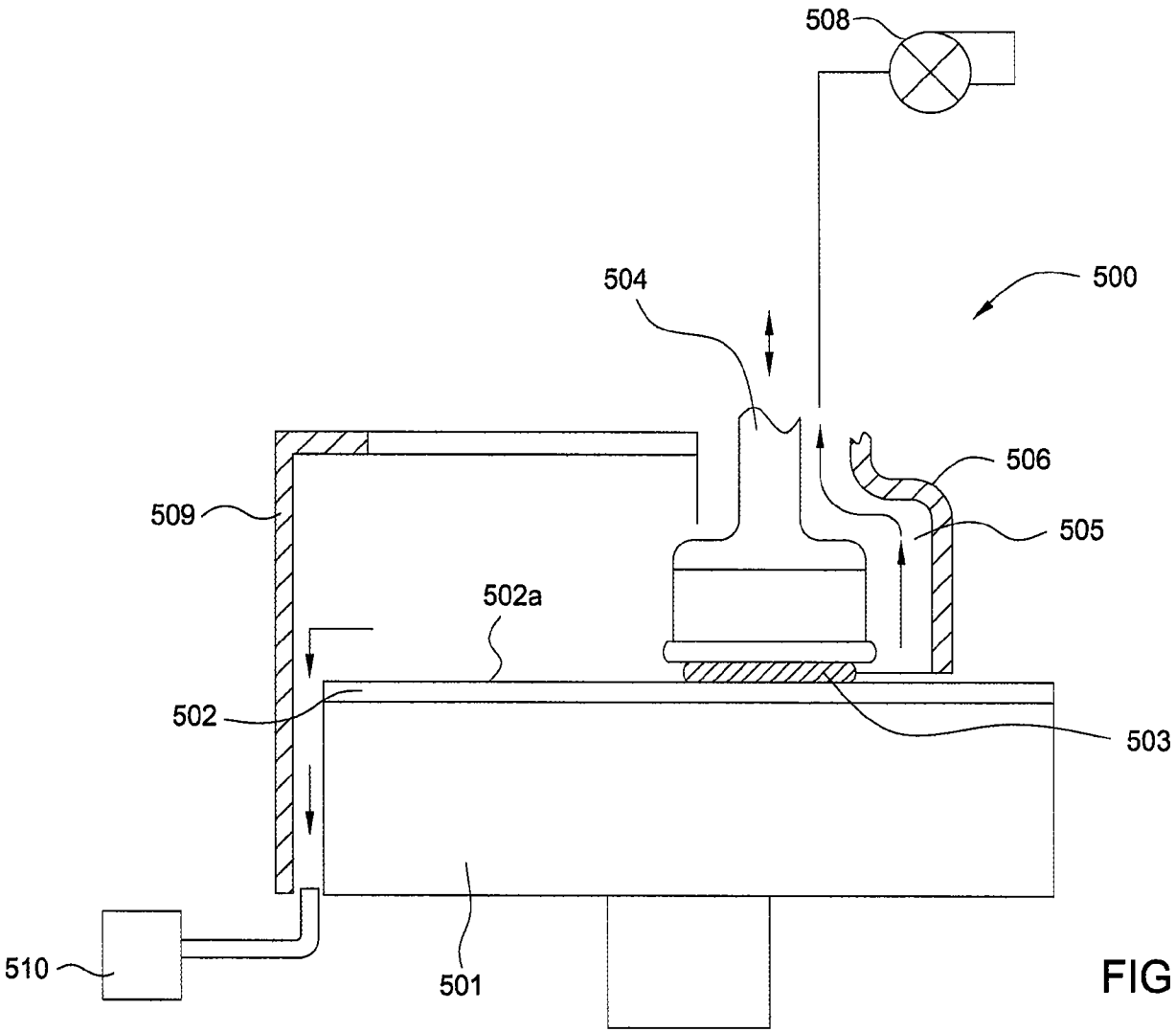
FIG. 5A is a schematic sectional side view of a polishing station in accordance with one embodiment of the present invention.
Figure 5B:
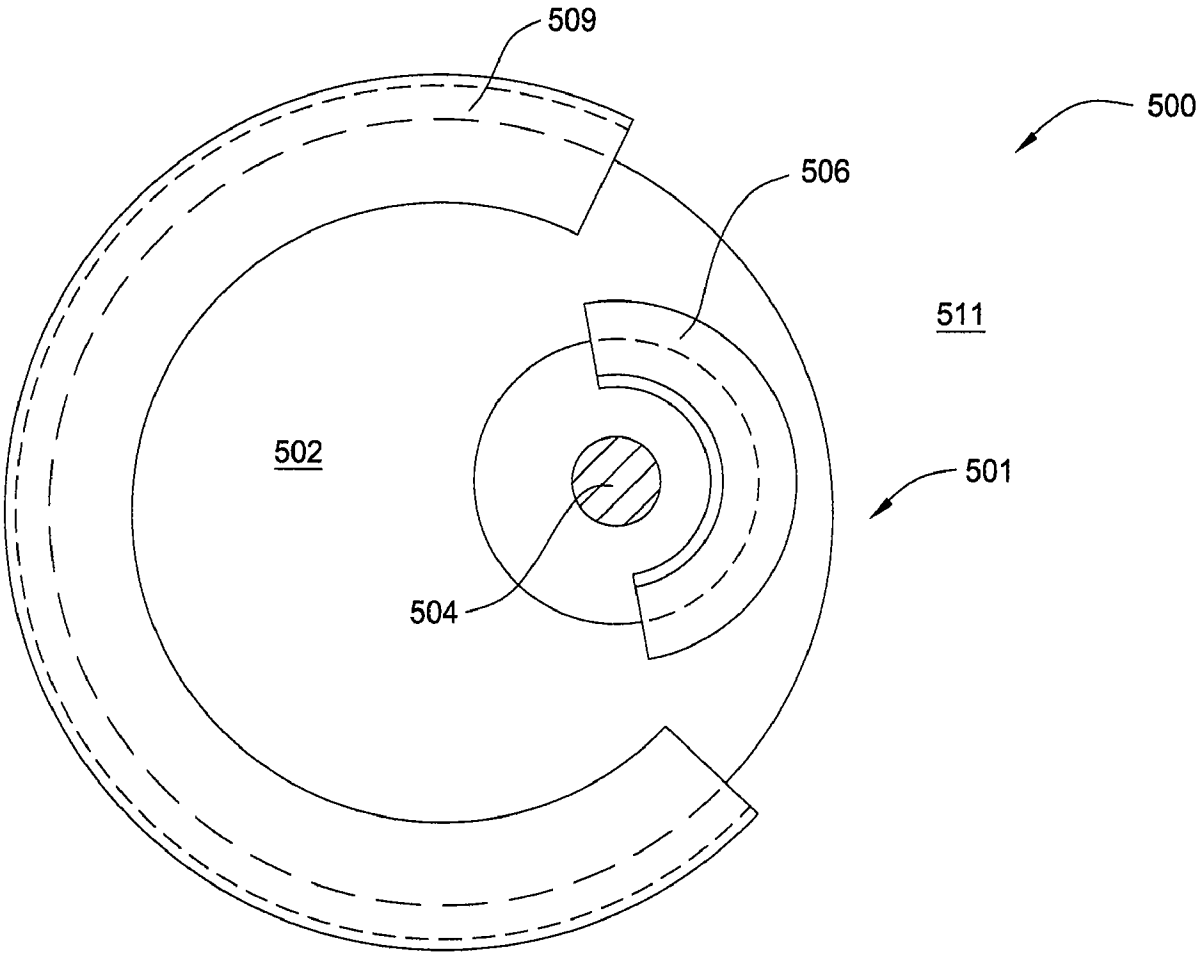
FIG. 5B is a schematic top view of the polishing station of FIG. 5A.

FIG. 5 is a schematic sectional side view of a polishing station 500 in accordance with another embodiment of the present invention. FIG. 5B is a schematic top view of the polishing station 500 of FIG. 5A. The polishing station 500 may be used in a polishing system or stand alone. The polishing station 500 generally comprises a platen 501 having a polishing pad 502 disposed thereon. The polishing pad 502 has a polishing surface 502*a* configured to polishing a substrate 503 when the substrate 503 is in contact with and pressed against the polishing surface 502*a*.

The polishing station 500 further comprises a polishing head 504 configured to transfer the substrate 503 and to support the substrate 503 during processing. The polishing head 504 moves relatively to and from the platen 501 to transfer substrates to and from load cups or other platens in a system. The substrate 503 being processed is generally secured on the polishing head 504 by vacuum using a membrane with a device surface of the substrate 503 facing down. During polishing, the polishing head 504 presses the substrate against the polishing pad 502 and allows the substrate to be polished through relative motion between the substrate and the polishing surface 502*a* and/or chemical reaction by the polishing solution. The polishing head 504 may rotate the substrate 503 about its central axis during processing. The polishing head 504 may also oscillate to generate a sweeping motion during polishing for a uniform result.

In one embodiment of the present invention, the polishing station 500 comprises a head shield 506 partially surrounding the polishing head 504 and a platen shield 509 partially surrounding the platen 501. The head shield 506 and the platen shield 509 substantially surround the entire perimeter of the substrate 503 and are configured to remove any chemical fume, vapor of polishing solution, or any byproduct generated in the polishing station 500 during polishing.

The head shield 506, similar to the exhaust shield 406 of FIG. 4, is attached to the polishing head 504 and is configured to retain chemical fumes, vapor of polishing solution and other byproducts. In one embodiment, a vacuum system 508 is in fluid communication with an inner volume 505 of the head shield 506.

The platen shield 509 is similar to the exhaust shield 206 of FIG. 2. However, the platen shield 509 only partially surrounds the platen 501 leaving an opening 511 which allows the polishing head 504 to access the platen 501 without vertical motion from the platen shield 509. The platen shield 509 partially surrounds the platen 501 and retains chemical fumes, vapor of polishing solution and other byproducts within. In one embodiment, a vacuum system 510 is in fluid communication with an inner volume of the platen shield 509. In one embodiment, the vacuum system 510 and the vacuum system 508 may be combined.

The platen shield 509 and the head shield 506 may be formed by material compatible with processing chemistry. In one embodiment, the exhaust shield 406 is made of polyvinyl chloride (PVC).

Even though a polishing process is described with the localized exhaust assembly in accordance with one embodiment of the present invention, a person skilled in the art can apply the localized exhaust assembly in any suitable processes, such as wet cleaning, electroplating, and electroless plating.

While the foregoing is directed to embodiments of the present invention, other and further embodiments of the invention may be devised without departing from the basic scope thereof, and the scope thereof is determined by the claims that follow.

What is claimed is:

1. An apparatus for polishing a substrate, comprising:

a platen having a polishing surface configured to polish the substrate;

a polishing head configured to support the substrate and position the substrate to be in contact with the polishing surface during polishing;

a solution nozzle configured to dispense a polishing solution on the polishing surface; and an exhaust assembly surrounding the platen at a horizontal level substantially near the polishing surface to define a processing volume above the polishing surface, wherein the exhaust assembly is vertically movable along the platen by a motion device and has a plurality of through openings distributed around the circumference of the exhaust assembly.

2. The apparatus of claim 1, further comprising:

a vacuum pump in fluid communication with the processing volume through the plurality of through openings.

3. The apparatus of claim 1, wherein the exhaust assembly comprises a cylindrical shell surrounding sides of the platen.

4. The apparatus of claim 2, wherein the exhaust assembly further comprises:

an annular pipe surrounding the platen, the annular pipe being in fluid communication with the plurality of through openings;

a fluid channel connecting the annular pipe to the vacuum pump.

5. The apparatus of claim 1, wherein the exhaust assembly is made of PVC (polyvinyl chloride).

6. The apparatus of claim 1, wherein the exhaust assembly is vertically movable between an operating position in which the plurality of through openings are adjacent to and relatively above the polishing surface and a maintaining position in which the plurality of through openings are relatively below the polishing surface.

7. A method for polishing a substrate, comprising:

securing the substrate to a polishing head;

rotating a platen having a polishing surface configured to polish a surface of the substrate;

dispensing a polishing solution to the polishing surface;

pressing the surface of the substrate against the polishing surface;

retaining undesired byproducts generated during polishing within a confined volume using an exhaust shield configured to substantially surround the platen and the polishing head, wherein the exhaust shield is vertically movable along the platen; and vacuuming the confined volume through a plurality of through holes distributed around the circumference of the exhaust shield to remove undesired byproducts.

8. The apparatus of claim 1, further comprising:

a loading cup configured to transfer the substrate to and from the polishing head, wherein the loading cup is isolated by the exhaust assembly from the platen during polishing.

9. The method of claim 7, wherein the exhaust shield is vertically movable between an operating position in which the plurality of through holes are adjacent to and relatively above the polishing surface and a maintaining position in which the plurality of through holes are relatively below the polishing surface.

10. The method of claim 7, wherein the confined volume is isolated through the exhaust shield from a loading cup during polishing.

11. An apparatus for polishing a substrate, comprising:

a platen having a polishing surface;

a polishing head disposed at a position opposite to the polishing surface;

an exhaust assembly surrounding substantially the polishing surface of the platen to define a processing volume above the polishing surface, wherein the exhaust assembly is vertically movable along the platen and has a plurality of through holes distributed along the inner periphery of the exhaust assembly;

a vacuum pump in fluid communication with the processing volume through the plurality of through holes.

12. The apparatus of claim 11, wherein the exhaust shield is vertically movable between an operating position in which the plurality of through holes are adjacent to and relatively above the polishing surface and a maintaining position in which the plurality of through holes are relatively below the polishing surface.

13. The apparatus of claim 11, further comprising:

a loading cup configured to transfer the substrate to and from the polishing head, wherein the loading cup is isolated through the exhaust assembly from the platen during polishing.

* * * * *